US006230629B1

(12) United States Patent
Doctor et al.

(10) Patent No.: US 6,230,629 B1
(45) Date of Patent: May 15, 2001

(54) RAPID IGNITION INFRARED DECOY FOR ANTI-SHIP MISSILE

(75) Inventors: Michael Doctor; John Horton, both of Panama City Beach; Robert Woodall, Lynn Haven, all of FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/246,209

(22) Filed: Jan. 21, 1999

(51) Int. Cl.[7] ..... F42B 4/28; F42B 4/26; F41F 5/00

(52) U.S. Cl. ..... 102/337; 102/341; 89/1.11

(58) Field of Search ..... 102/334, 336, 102/337, 505, 341, 259; 89/1.11

(56) References Cited

U.S. PATENT DOCUMENTS 3,759,216 * 9/1973 Sanders et al. ..... 116/124 B
4,069,762 * 1/1978 Maury ..... 102/90
4,307,665 * 12/1981 Block et al. ..... 102/505
4,624,186 * 11/1986 Widera et al. ..... 102/336
4,719,857 * 1/1988 Spring ..... 102/335
5,331,897 * 7/1994 Handler ..... 102/341
5,435,224 * 7/1995 Andreotti et al. ..... 89/1.11
5,895,882 * 4/1999 Woodall, Jr. ..... 102/341
5,951,346 * 9/1999 Woodall, Jr. ..... 441/7

* cited by examiner

*Primary Examiner*—Michael J. Carone
*Assistant Examiner*—Aileen J. Baker
(74) *Attorney, Agent, or Firm*—Harvey A. Gilbert; Donald G. Peck

(57) ABSTRACT

An IR radiating decoy for an IR seeking anti-ship missile (ASM) includes a propulsion section, safe and arming section, gas generator section, fuel tank section, and flight stabilization section to ignite and continuously maintain an IR plume for decoying the ASM away from the targeted ship. The IR radiating decoy ignites the IR plume immediately when the decoy reaches a safe separation distance from the targeted ship. The IR plume continues to be emitted as the decoy flies away, as it lands on the water, and while it floats upon the water until all the fuel is used from the fuel tank. The fuel can be changed to change the signature of the IR plume so that different ASM missiles can be drawn away from the ship.

16 Claims, 8 Drawing Sheets

RAPID IGNITION INFRARED DECOY FOR ANTI-SHIP MISSILE

STATEMENT OF GOVERMENT INTEREST

The invention described herein may be manufactured and used by or for the Government of the United States of America for governmental purposes without the payment of any royalties thereon or therefor.

BACKGROUND OF THE INVENTION

This invention relates to decoys for anti-ship missiles. In particular, this invention relates to a decoy continuously emitting an infrared (IR) plume from immediately after launch through the time it floats on the water.

Liquid fueled, IR radiating decoys have been used that produce an IR plume, or signature after they have been launched, entered the water, and floated back to the surface. Because these decoys do not produce an IR decoy plume immediately after launch, a finite time passes while the decoy is launched, flies through the air, impacts the water, sinks, and then is buoyed back to the surface before it begins to produce its decoying IR plume. Consequently, such decoys do not provide adequate ship protection because during the interval while the decoy is in the air and underwater, the ship is vulnerable to an incoming IR radiation-seeking anti-ship missile (ASM).

Some ASM decoy systems use activated metals to produce IR signatures immediately upon launch. However, these decoys create only short bursts of IR radiation that rapidly fade as the expelled metal diffuses in the air and/or the chemical reaction wanes. Since the activated metal IR radiating decoys do not produce a constant IR plume over a prolonged period, successive IR radiating decoys have to be launched in a properly spaced sequence while the ship is moving. A more serious consequence of using successive IR radiating decoys is that they may actually draw an ASM seeker back to the targeted ship after the IR cloud of a previous burst has already decoyed the missile away.

Thus, in accordance with this inventive concept, a need has been recognized in the state of the art for an ASM decoy emitting an IR plume immediately upon launch from a platform, during flight away from the platform, and later while floating on the surface of the water.

SUMMARY OF THE INVENTION

The present invention is directed to providing a decoy for an IR radiation seeking missile. The decoy ignites an IR plume immediately at safe separation distance from an IR radiating target and continuously maintains the IR plume while the decoy flies away from the target and while it floats on the water to draw the IR seeking missile away from the target.

An object of the invention is to provide a decoy for an ASM that produces an IR decoy plume immediately upon reaching safe separation distance from a ship.

Another object of the invention is to provide a decoy for an ASM having a primary advantage over previous countermeasure devices by its production of an immediate, continuous, and sustained IR decoying signature.

Another object is to provide a decoy for an ASM producing IR radiation immediately after launch and continuously thereafter while it floats on the water away from the targeted ship.

Another object of the invention is to provide a decoy for an IR seeking missile emitting continuous IR radiation for a number of minutes as determined by the size of its gas generator and fuel tank.

Another object of the invention is to provide a decoy for an IR seeking missile that is capable of diverting the missile from a target that has been acquired and locked onto by the missile.

Another object of the invention is to provide a decoy for an IR seeking missile burning different fuels to create different IR radiations that decoy different IR seeking missiles.

Another object of the invention is to provide a decoy for IR seeking missiles having a safe and arm section completing an explosive train in ordnance right after exit from the launcher.

Another object of the invention is to provide a decoy for an IR seeking missile having a liquid fuel interlock in the safe and arm section.

Another object of the invention is to provide a decoy for an ASM having parachutes and flotation collar that function in consonance with the generation of a large IR plume.

Another object of the invention is to provide a decoy for an IR seeking missile having a fuel delivery and mist creating system that functions at all encountered flight aspects and angles during deployment.

These and other objects of the invention will become more readily apparent from the ensuing specification when taken in conjunction with the appended claims.

DESCRIPTION OF THE PREFERRED EMDODIMENT

Figure 1:
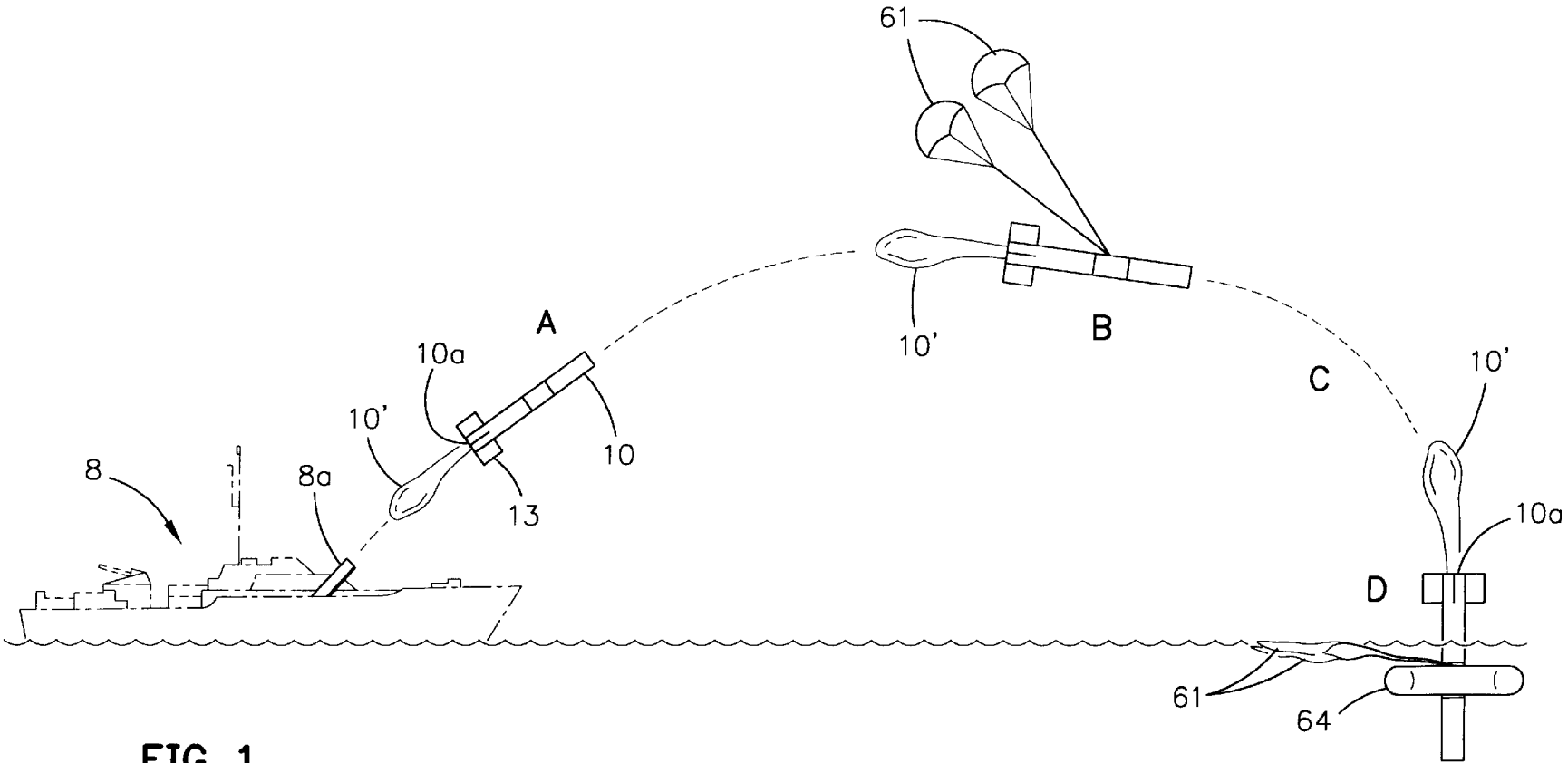
FIG. 1 schematically shows the decoy emitting an IR decoy plume during deployment from a ship.

Referring to FIG. 1 of the drawings, ship 8 is perceived to be under threat from anti-ship missile ASM. The ASM has an infrared (IR) seeker tuned to home in on at least part of the IR radiated signature of ship 8.

To neutralize this threat, decoy 10 is launched from launcher 8*a* on ship 8. Immediately, decoy 10 emits IR decoy plume 10' continuously to draw ASM away from ship 8.

Figure 2:
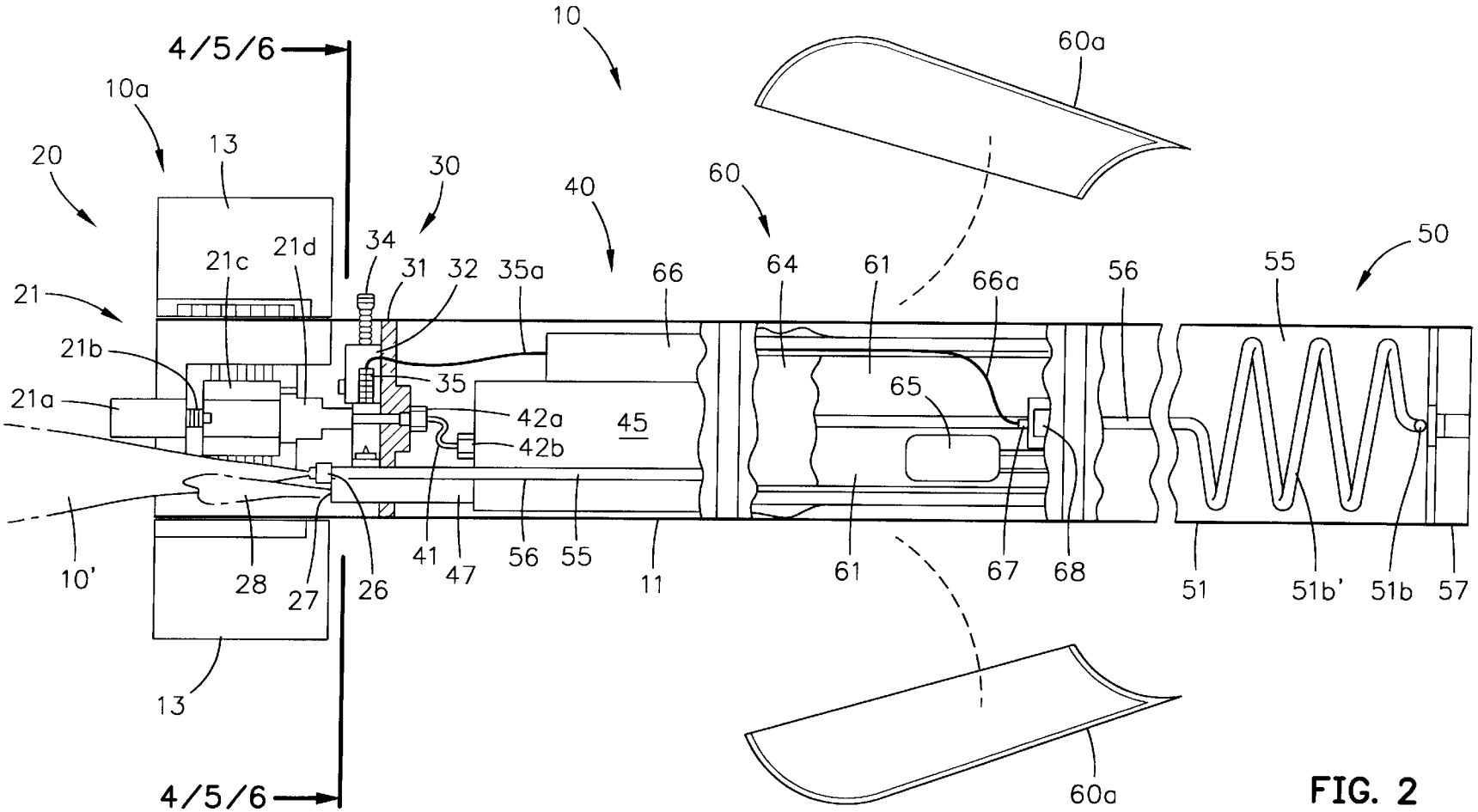
FIG. 2 is a cross-sectional view of details of the decoy.
Figure 3:
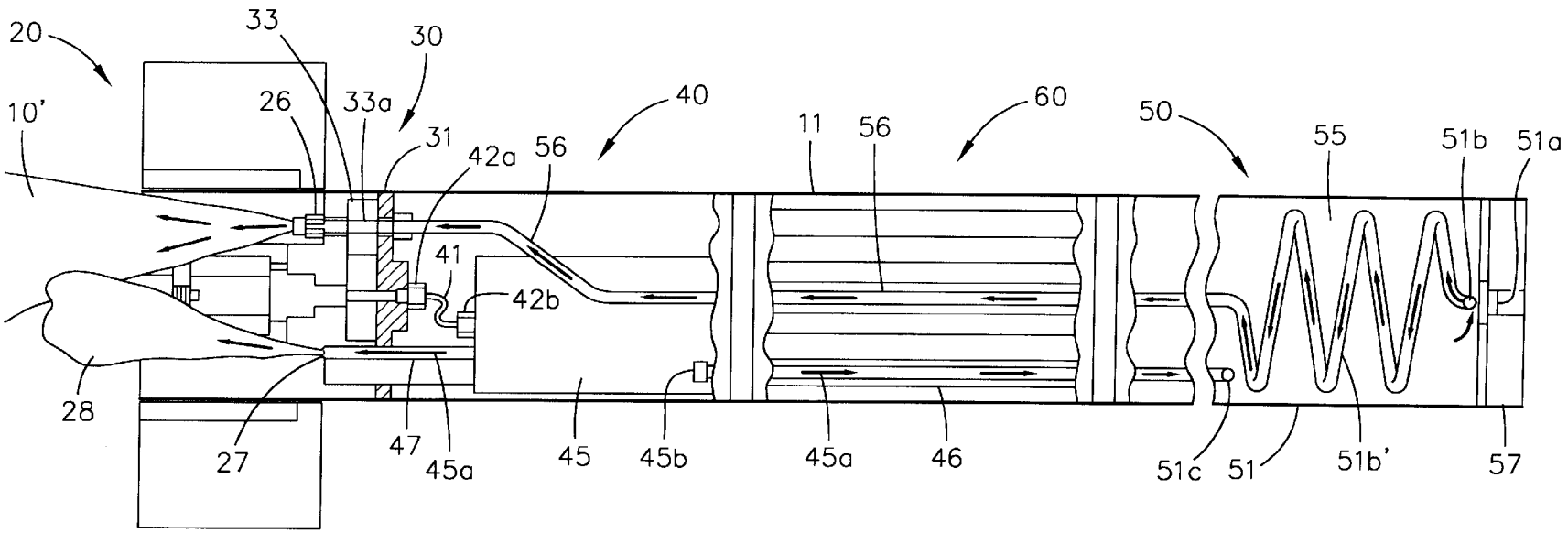
FIG. 3 is a cross-sectional view of other details with the decoy being rotated along its longitudinal axis.
Figure 8A:
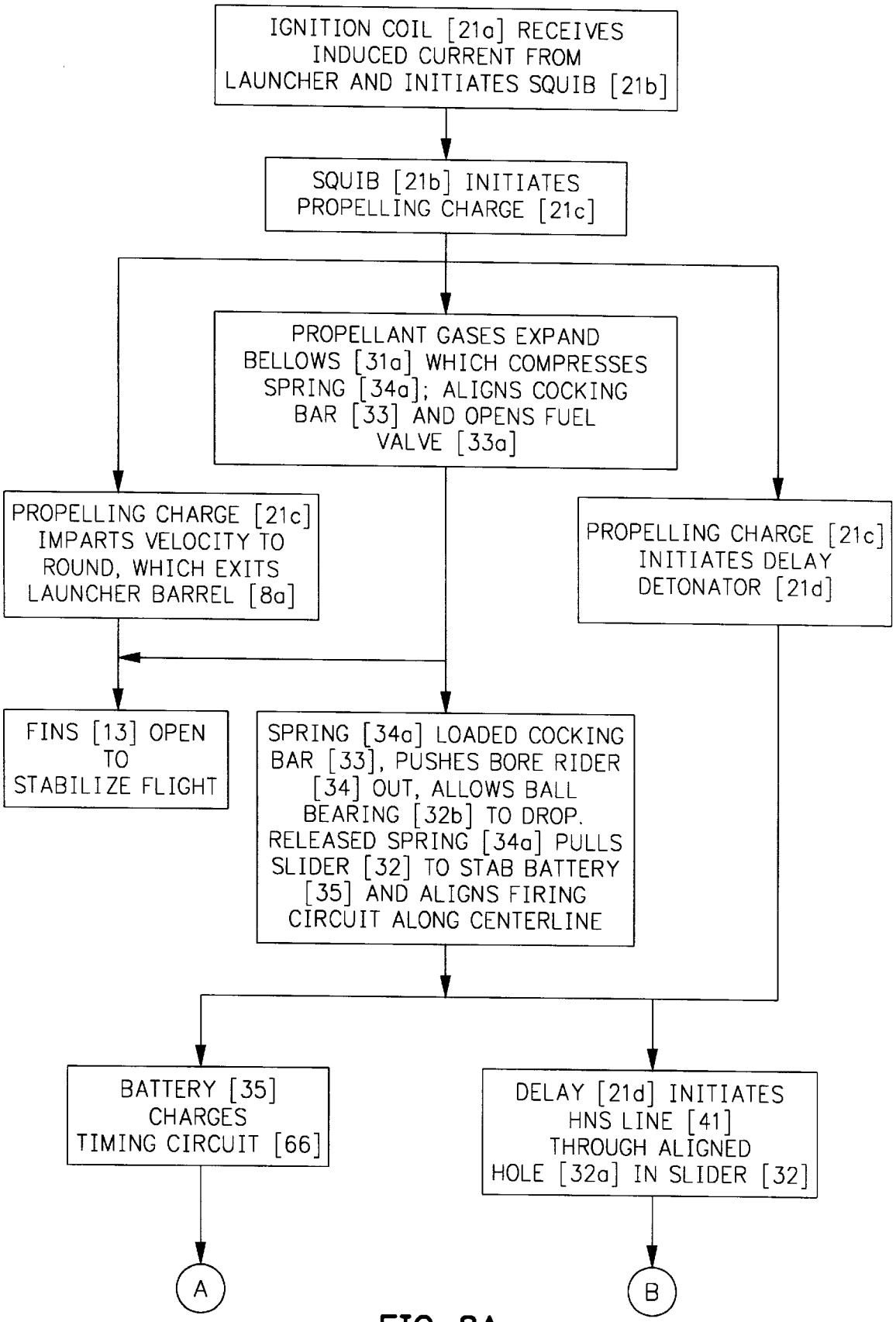
FIGS. 8A, 8B, and 8C show a flow diagram during deployment of the decoy.
Figure 8B:
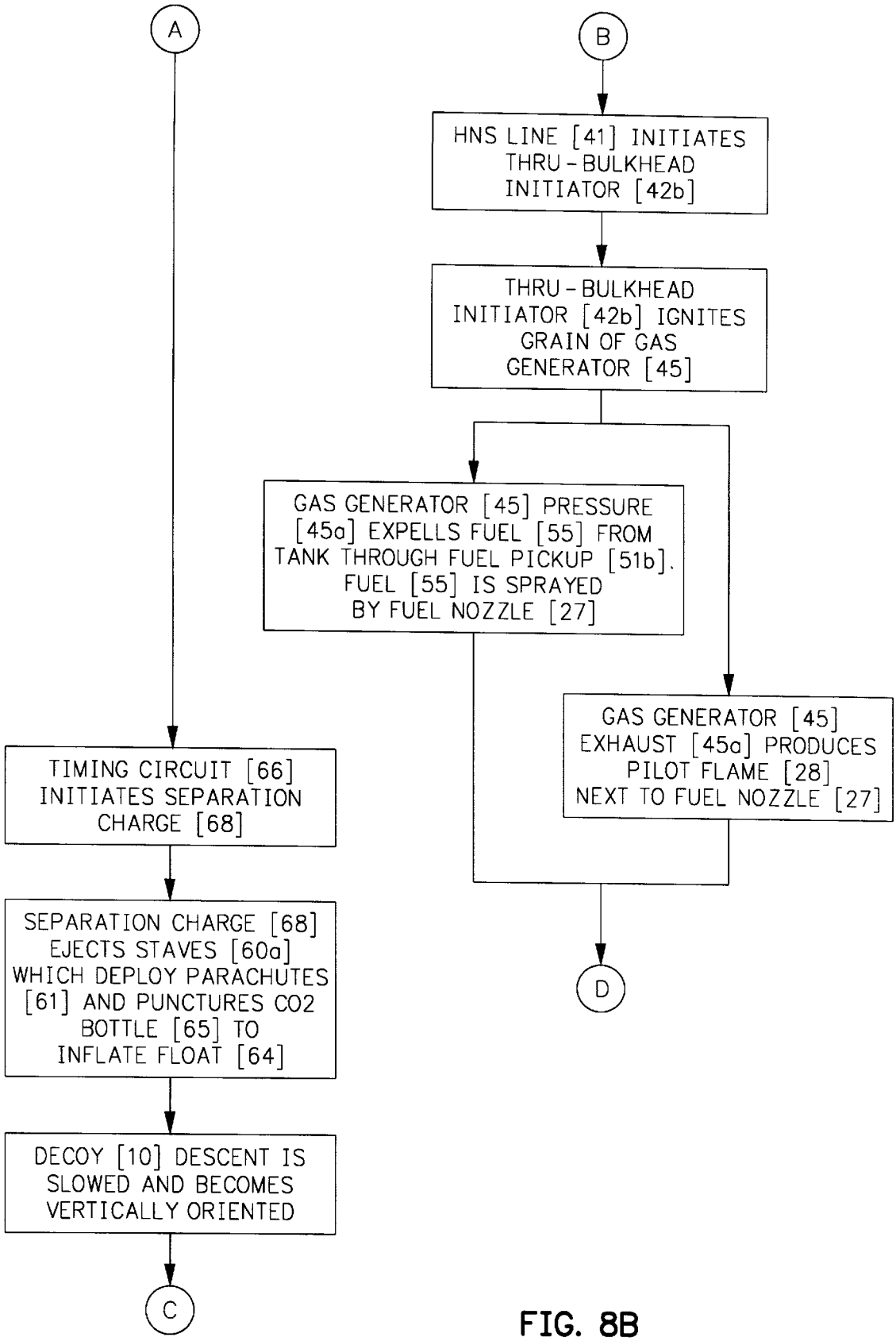
Figure 8C:
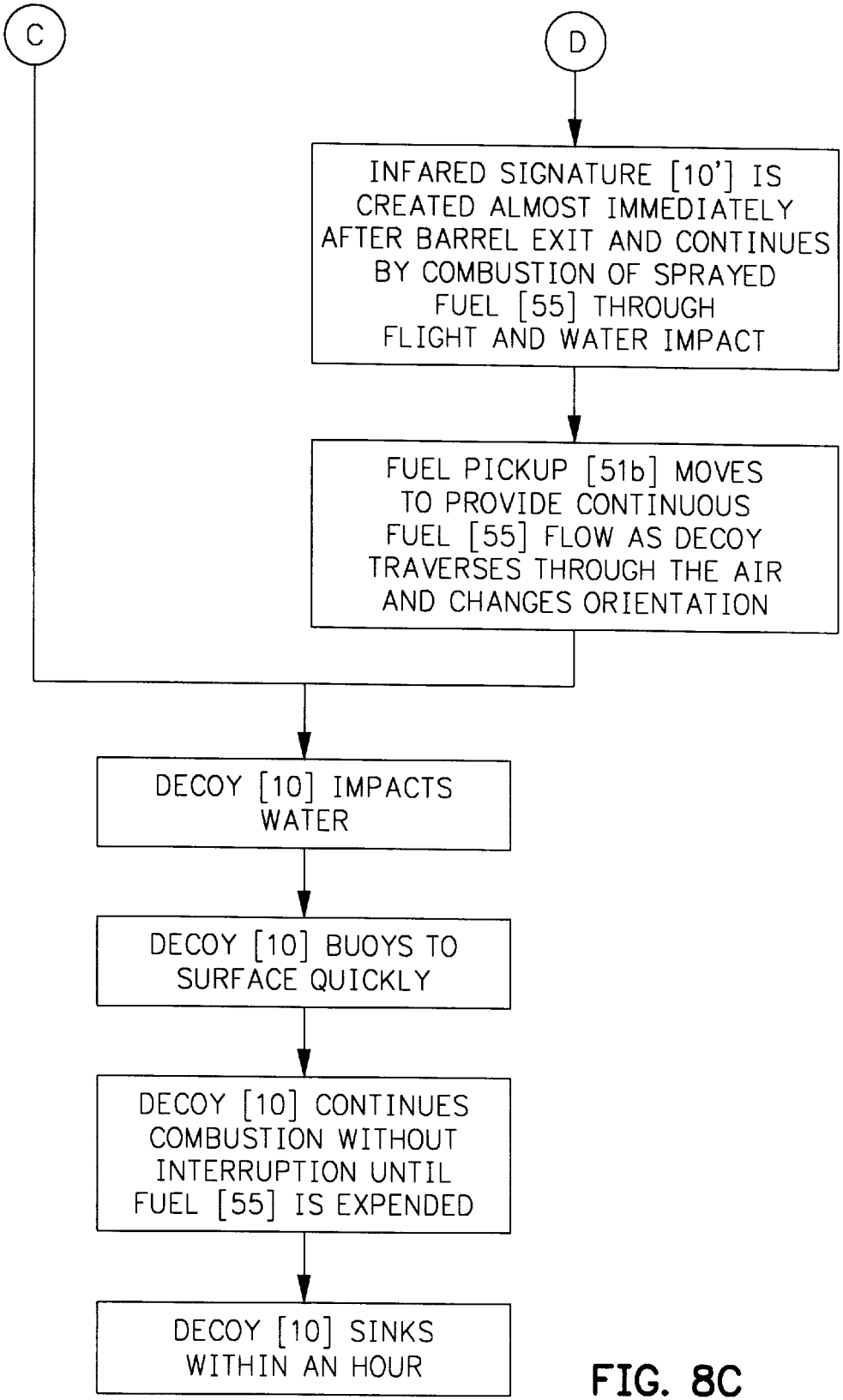

Referring also to FIGS. 2 and 3, and the flow diagram of FIGS. 8A, 8B, and 8C, decoy 10 is housed in an elongate tubular canister 11. Canister 11 contains propulsion section 20, safe and arming section 30, gas generator section 40, fuel tank section 50, and flight stabilization section 60 that cooperate to immediately create and continuously maintain IR plume 10'.

Decoy 10 is launched from launcher 8*a* by mortar charge or rocket motor 21 located in propulsion section 20 at end 10*a* of decoy 10. Launcher 8*a* is a tubular structure, although other configurations might be used if needed. Rocket motor 21 in launch tube 8*a* propels decoy 10 a safe separation distance A from ship 8.

At safe separation distance A decoy 10 immediately starts to emit IR plume 10' that will safely decoy the ASM away. Safe separation distance A is the minimum distance from ship 8 that will not cause unacceptable damage or casualties if decoy 10 should explode due to malfunction of components or if too much heat is radiated as IR plume 10' is emitted from decoy 10.

IR plume 10' is emitted from end 10*a* of decoy 10 as gas generator section 40 burns a mist form of fuel 55 coming from fuel tank 51 of fuel tank section 50. Decoy 10 progresses on its outward bound path from ship 8, and IR decoy plume 10' continues to be emitted. About the time when decoy 10 reaches apogee B in its path, at least one parachute 61 is deployed from flight stabilization section 60 to slow decoy 10 during its descent C. Meanwhile or shortly after parachutes 61 are deployed, flight stabilization section 60 releases flotation collar 64. Flotation collar 64 is inflated to an annular shape around decoy 10 by source 65 of pressurized gas, probably $CO_2$.

The slowed descent provided for by parachutes 61 and collar 64 protects decoy 10 from damage during impact D with water and also prevents decoy 10 from being fully submerged in the water. In other words, parachutes 61 and flotation collar 64 do not only vertically orient decoy 10, but also do not permit end 10*a* of decoy 10 from being under water. Consequently, IR plume 10' is continuously emitted upwardly. Thus, IR plume 10' is emitted as soon as possible at safe separation distance A after decoy 10 leaves launch tube 8*a*, during the time it travels away from ship 8, and afterward as it floats on water D.

Figure 4:
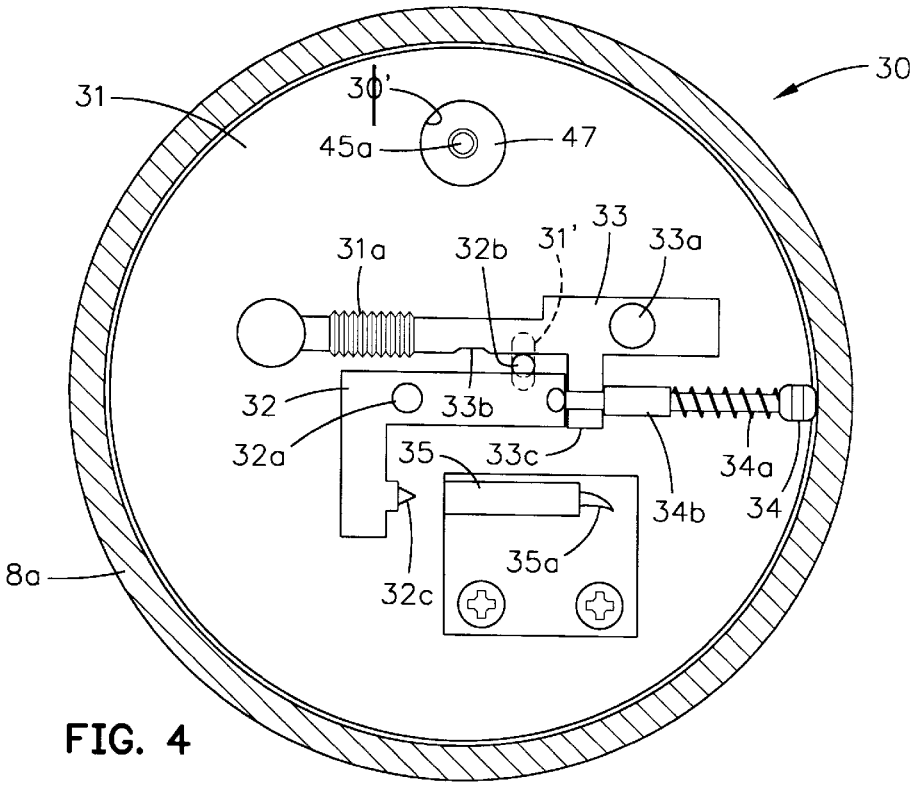
FIG. 4 is an end view of the safe and arming section taken generally along lines 4/5/6 in FIG. 2 during storage and launch.

Referring to FIG. 4, during periods of storage or while decoy 10 is in launch tube 8*a*, safe and arm section 30 of decoy 10 prevents decoy 10 from being inadvertently activated. Safe and arm section 30 has disc-shaped mounting plate 31 that receives duct 47 from gas generator 45. Mounting plate 31 extends across canister 11 and supports and guides slider 32. Slider 32 positions slider hole 32*a* out-of-line with an explosive train that would otherwise run between delay detonator 21*d* of propulsion section 20 and explosive HNS line 41 of gas generator section 40. Mounting plate 31 also supports and guides cocking bar 33 that valves, or allows the flow of fuel 55 which is burned to produce IR plume 10'. Fuel 55 from fuel tank 51 of fuel tank section 50 is sealed within the fuel tank by a face seal, not shown, that is mounted on the back side of cocking bar 33 and abuts the end of fuel line 56. Fuel valve hole 33*a* in cocking bar 33 is not aligned with fuel line 56 during storage and prior to launch. This dynamic mechanical seal on cocking bar 33 is unique to this invention to assure safe, reliable launches.

Since both slider 32 and cocking bar 33 are supported and guided by mounting plate 31, they may be provided with keys or similar projections on their backsides that engage slots or keyways on mounting plate 31. These mutually engaging surfaces guide and restrict their lateral motion as described below.

Figure 5:
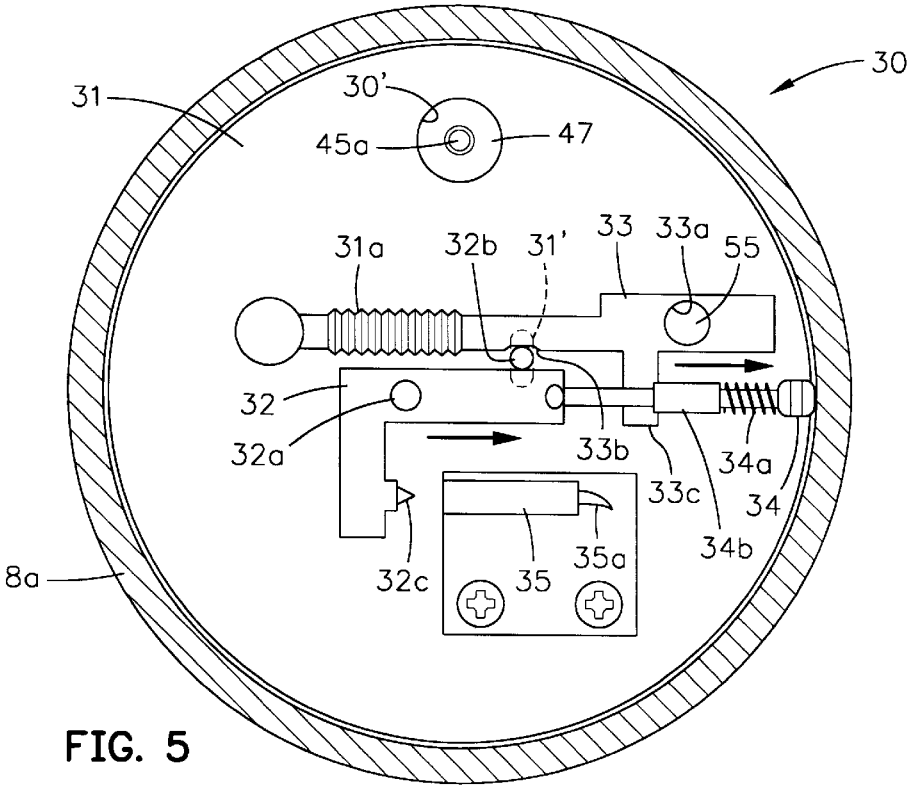
FIG. 5 is an end view of the safe and arming section taken generally along lines 4/5/6 in FIG. 2 after ignition of the propellant charge and while the decoy is in the launch tube.

Referring to FIGS. 2 and 5, when decoy 10 is launched, rocket motor 21 of propulsion section 20 is initiated by command signals from ship 8 to coil 21*a* and interconnected squib 21*b*. Initiation of squib 21*b* causes controlled detonation of propelling charge 21*c* that ignites delay detonator 21*d*. After propelling charge 21*c* is initiated, launch pressure is developed by propellant gasses from propelling charge 21*c* and delay detonator 21*d* to propel decoy 10 outward in launcher tube 8*a*. The launch pressure, or propellant gases accelerate decoy 10 in launcher tube 8*a* and also reach safe and arm section 30. At safe and arm section 30 the launch pressure expands bellows 31*a* which pushes cocking bar 33 to the right, as shown. This displacement of cocking bar 33 opens fuel valve hole 33*a* by aligning hole 33*a* with fuel line 56 to allow fuel 55 from fuel tank 51 to pass to fuel nozzle 26 in propulsion section 20.

This motion to the right of cocking bar 33 also frees detent, or locking ball 32*b* to move a short distance orthogonally from slider 32 in groove 31' from its location in a recess in slider 32. Groove 31' is machined in mounting plate 31 to orthogonally extend from both slider 32 and cocking bar 33. Groove 31' only need to be long enough to provide a path for detent ball 32*b* to ride out of slider 32 and into recess 33*b* in cocking bar 33. Ball 32*b* is held in recess 33*b* by the upper edge of slider 32. This motion of detent ball 32*b* frees slider 32 for later motion to the right. Since detent ball 32*b* is restricted from motion to the right or left by groove 31' locking ball 32*b* in recess 33*b* locks cocking bar 33 from further motion in either direction that would otherwise take hole 33*a* from its aligned position with fuel line 56. Thus, the aligned hole 33*a* and fuel line 56 allows fuel 55 to pass continuously after their alignment. At this time, slider hole 32*a* is not aligned with delay detonator 21*d*, initiator 42*a*, HNS line 41, and initiator 42*b*, so that slider 32 interrupts the explosive train.

Virtually simultaneously, projection 33*c* compresses spring 34*a* of bore rider 34 via sleeve 34*b*. Bore rider spring 34*a* is restrained from expansion by bore rider 34 which presses against the inside of launch tube 8*a*. Consequently, bore rider 34, spring 34*a*, and slider do not move while decoy 10 is in launch tube 8*a*.

Propellant gases from propelling charge 21*c* thereby ignite delay detonator 21*d*, propel decoy 10 clear of launcher tube 8*a*, and arm cocking bar 33. As decoy 10 leaves tube 8*a*, fins 13 open to stabilize flight.

Figure 6:
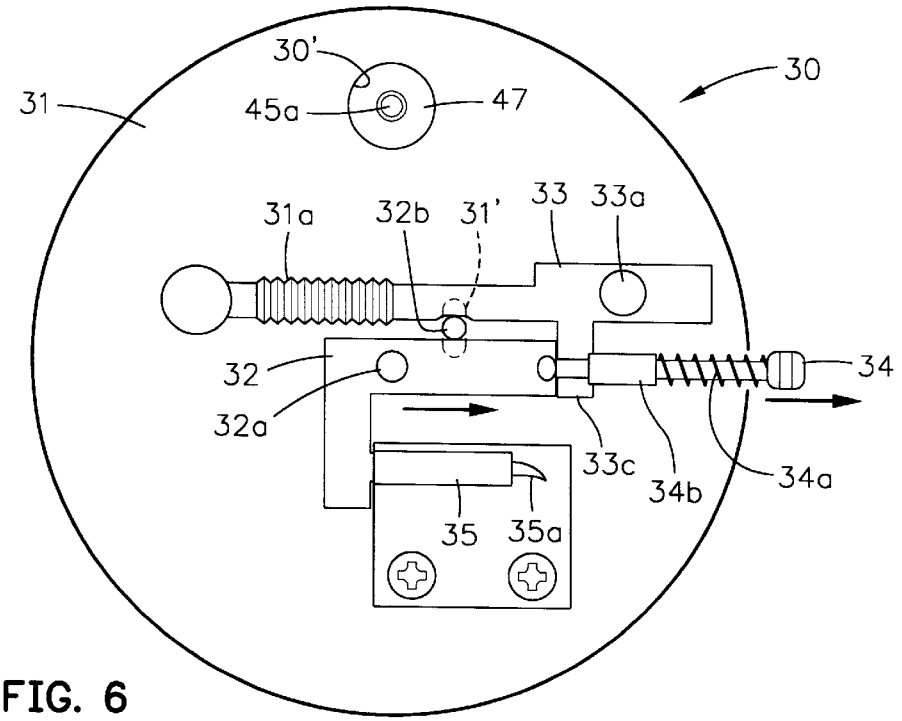
FIG. 6 is an end view of the safe and arming section along lines 4/5/6 in FIG. 2 after decoy exits the launch tube.

Noting FIG. 6, as decoy 10 leaves launch tube 8*a*, bore rider 34 of safe and arm section 30 is no longer restrained so that spring 34*a* pushes against projection 33*c* and pushes bore rider 34 to the right. Since bore rider 34 is connected to slider 32, spring 34*a* also pulls slider 32 to the right, as shown by the arrow under bore rider 34. This displacement positions, or aligns slider hole 32*a* with the explosive train between delay detonator 21*d* and initiator 42*a*, HNS explosive line 41, and initiator 42*b*. The motion of slider 32 to the right also brings firing pin tip 32*c* to penetrate thermal battery 35. This penetration completes a circuit from battery 35 to timing circuit 66 in flight stabilization section 60. This enables power to be fed from battery 35 over lead 35*a* to start timing circuit 66, also see FIG. 2.

After the short detonation time of delay detonator 21*d*, it fires through slider hole 32*a* to initiate firing initiator 42*a*, HNS line 41, and initiator 42*b* to start gas generator 45 which produces pressurized gas 45*a*. The short detonation time of fast burning delay detonator 21*d* transmits the explosive train through slider hole 32*a* and assures the virtual immediate activation of initiator 42*a*, HNS line 41, initiator 42*b*, and gas generator 45. This occurs after decoy 10 exits from launcher tube 8*a* and flies to safe separation distance A. In other words, the time it takes for delay detonator 21*d* to be detonated sufficiently to initiate elements 42*a*, 41, 42*b* and generator 45 is equivalent to the time it takes for decoy 10 to travel safe separation distance A. The explosive gases created from HNS line 41 and bulkhead initiator 42 reach boron potassium nitrate pellets inside gas generator 45, and they immediately start to burn and produce pressurized gas 45*a*.

Pressurized gas 45*a* is fed through duct 47 that extends from gas generator 45 through mounting plate 31 of safe and arm section 30 and to shock nozzle 27. Pressurized gas 45*a* has the properties of combustion that cause it to automatically ignite and create pilot flame 28 when it passes through shock nozzle 27 to the surrounding air.

Pressurized gas 45*a* also is used to pressurize fuel tank 51 of fuel tank section 50, see FIG. 3. Pressurized gas 45*a* is forced past blowout plug 45*b* of generator 45, through gas pressure line 46, through pressure port 51*c*, and into fuel tank 51.

Fuel tank 51 has three ports: fill port 51*a* for filling the tank, an exit, or fuel port 51*b* coupled to flexible pickup tube 51*b'* that is connected to fuel line 56, and a pressure port 51*c* that receives pressurized gas 45*a*. All three ports are closed during storage. Port 51*a* is closed by a threaded gas fitting; exit, or fuel port 51*b* is closed by cocking bar 33 having fuel valve hole 33*a* non-aligned with fuel line 56; and pressure port 51*c* is closed by blowout plug 45*b* at the output of gas generator 45 and input of gas pressure line 46.

After decoy 10 exits launch tube 8*a* and safe and arm section 30 functions, fill port 51*a* stays closed; cocking bar 33 opens, or aligns, fuel valve hole 33*a* with fuel line 56 to open exit port 51*b;* and pressurized gas 45*a* from gas generator 45 blows out blowout plug 45*b* and reaches pressurize fuel tank 51. This pressure in fuel tank 51 forces fuel 55 through exit port 51*b* in flexible pickup tube 51*b'*, through fuel line 56, through fuel valve hole 33*a*, and through plume nozzle 26. This pressure also creates a mist of fuel 55 as it is forced through plume nozzle 26. This fuel mist of fuel 55 is ignited by pilot flame 28 and burns as IR plume 10' at end 10*a* of decoy 10.

Flexible tube 51*b'* and pickup 51*b* are designed to move within fuel tank 51 and to stay below the level of liquid fuel 55 during flight and after water impact by decoy 10. This feature helps assure continuous fuel flow and generation of IR plume 10' throughout the deployment sequence.

Referring to FIGS. 1 and 2, timing circuit 66 in flight stabilization section 60 is initiated and activated via lead 35*a* from thermal battery 35. After a set period, or predetermined interval which usually lasts long enough for decoy 10 to reach apogee B, timing circuit 66 sends a signal over lead 66*a* to detonate squib 67 and separation charge 68. This detonation blows free at least a pair of stave-shaped fairings 60*a* and deploys one or more parachutes 61. In addition, detonation of squib 67 and separation charge 68 also is used to vent the $CO_2$ from pressurized bottles 65 and inflate flotation collar 64. The deployed parachutes 61 and flotation collar 64 slow decoy 10 during descent C and allow a relatively soft water entry D a safe distance away from ship 8. The parachutes and flotation collar also orient decoy 10 in an upright position with its end 10*a* above water throughout this phase of the deployment sequence so that IR plume 10' continues to be emitted continuously and without interruption from first ignition. Weighted nose portion 57 of fuel tank section 50 can be included to help orient decoy 10 through flight and while it is in the water.

Flotation collar 64 floats decoy 10 on top the water where it emits its decoying IR plume 10' until all fuel 55 is used. Then after a period of time, bleed valves in flotation collar 64 allow $CO_2$ to bleed off and decoy 10 sinks into the ocean depths.

Figure 7:
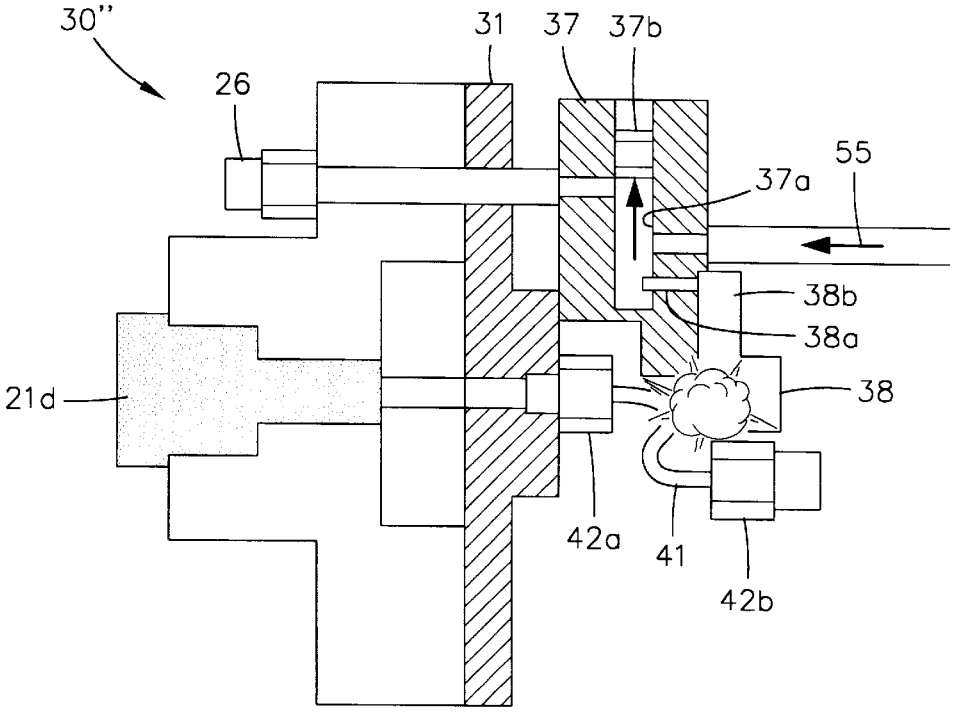
FIG. 7 shows a modified safe and arming section.

Although exemplary components of safe and arm section 30 are described herein, it is to be understood that other quick response arrangements are envisioned within the scope of this invention. For example, noting FIG. 7, a modified safe and arm section 30" could additionally have cylindrically-shaped body member 37 provided with an axial bore 37*a*. Before detonation of HNS line 41, piston 37*b* is retained at the bottom of bore 37*a* by projection 38*a* of deformable link 38. Since HNS line 41 is in the close proximity of deformable link 38, detonation of HNS line 41 as described above, breaks, or shatters link 38. Breaking link 38 releases spring 38*b* contained in link 38 to withdraw projection 38*a* from bore 37*a* and to free piston 37*b* to move from the bottom to the opposite end of bore 37*a* as shown by the large arrow in bore 37*a*. This motion by piston 37*b* opens the fuel lock that had been created by piston 37*b* and allows the pressurized flow of fuel 55 to nozzle 26. Thus, HNS line 41 not only initiates generation of pressurized gas 45*a* by gas generator 45 but also starts the pressurized flow of fuel 55 through safe and arm section 30". Having this invention in mind, one skilled in the art can assemble other arrangements of components for the safe and arm section.

Decoy 10, fabricated in accordance with this inventive concept, has advantages over the prior art decoys. These advantages arise by virtue of the fact that decoy 10 continuously produces IR plume 10' from the time when IR plume 10' is emitted immediately upon reaching safe separation distance A until the time that fuel 55 is completely used as decoy 10 sits on the water a distance away from the targeted ship. The duration of the burn can last for minutes if needed. The endurance, or capacity of decoy 10 to produce IR plume 10' continuously for a number of minutes is relative to the propellant capacity and burn rate in gas generator 45, capacity of tank 51, and/or how much fuel 55 is stored in it. The sizes of gas generator 45 and fuel tank 51 and, consequently, the time of functioning are limited by the storage volume that can be spared in ship's storage, and by the size of propulsive charge that launcher tube 8*a* can withstand without rupture. The distance of separation can be increased using a larger mortar or rocket.

Partially because of the capability of decoy 10 to create a large continuous IR plume 10' for relatively long periods of time, it can lure away an ASM away from a ship that has already been acquired and locked onto by the ASM. Another advantage of decoy 10 is that it can burn a number of different types of fuel in order to decoy other ASMs that are sensitive to other IR radiations.

Safe and arm section 30 completes an explosive train of ordnance immediately after decoy 10 reaches safe separation distance A. The liquid fuel interlock provided by aligned fuel valve hole 33*a* assures reliable and sustained generation of plume 10'. Parachutes 61 and flotation collar 64 of flight stabilization section 60 are actuated in such a manner so as to assure continuous generation of IR plume 10'. Fuel 55 is delivered and passed as mist through nozzle 26 at all required flight aspects and angles.

Although the invention of decoy 10 has been described thus far with respect to decoying an IR seeking ASM, this inventive concept also applies to decoying away other IR seeking missiles. Such other IR seeking missiles could be encountered in the theater of operations embracing the defense of land-based, high-priority IR emitting targets, such as power generation plants, manufacturing facilities, or armored vehicles, for example. Decoy 10 is easily modified to lure the other IR seeking missiles away from these targets by including different fuels 55 that emit appropriate IR signatures. When these fuels 55 that represent the other targets are burned, decoys 10 will decoy these other IR seeking missiles away from these targets as well. In the land-based configuration, however, flotation collar 64 may be dispensed with, or, perhaps, more fuel 55 may be carried.

The disclosed components and their arrangements as disclosed herein all contribute to the novel features of this invention. These novel features assure the continuous generation of IR plume 10' immediately after decoy 10 reaches a safe separation distance A from the launcher. Differently sized and shaped decoys could be fabricated for different tasks in accordance with this invention. The components of the sections of decoy 10 might necessarily have to be tailored for these different tasks, yet such modifications will be within the scope of this inventive concept. For example, different periods of emission and spectral emissions may be needed, chaff dispensing and/or other countermeasures might also be a requirement for some operational scenarios, or the decoy may need to include structure that allows it to be placed on various surfaces without departing from the scope of this invention.

Furthermore, having this disclosure in mind, one skilled in the art to which this invention pertains will select and assemble suitable components for the disclosed sections from among a wide variety available in the art and appropriately interconnect them to satisfactorily function as the disclosed constituents of decoy 10. Therefore, the disclosed arrangements are not to be construed as limiting, but rather, are intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A decoy for an IR seeking missile comprising:

means for launching a decoy for an IR seeking missile using launch pressure;

means for detonating an explosive train in said decoy;

a safe and arm section having a cocking bar provided with a valve hole to permit fuel to be valved therethrough in response to said launch pressure created during launch of said decoy, having a slider provided with a slider hole to transmit said explosive train therethrough in response to said decoy being propelled from said launching means, and having a bore rider to displace said slider to allow said explosive train to be transmitted therethrough;

means coupled to receive said explosive train for generating pressurized gas;

means coupled to receive said pressurized gas for forcing said fuel through said valve hole in said cocking bar; and means coupled to receive said pressurized gas for creating a pilot flame to ignite and burn said fuel as an IR plume at a safe separation distance from said launching means.

2. A decoy according to claim 1 further comprising:

means coupled to said valve hole of said cocking bar for spraying a mist of said forced fuel, said pressurized gas has the properties to combust and create said pilot flame as it passes through said creating means to surrounding air igniting and burning said fuel mist as said IR plume.

3. A decoy according to claim 2 further comprising:

means for propelling said decoy from said launching means; and means for storing said fuel in said decoy, said safe and arm section being coupled to said fuel storing means and said propelling means to receive said launch pressure, said detonating means being coupled to said propelling means and said safe and arm section, and said fuel storing means being coupled to said forcing means.

4. A decoy according to claim 3 wherein said bore rider displaces said slider when said decoy leaves said launching means, and said detonating means delays said explosive train a period of time for said decoy to be propelled a safe separation distance from said launching means.

5. A decoy according to claim 4 wherein said generating means is delayed from generating said pressurized gas until said decoy is propelled said safe separation distance where said IR plume is immediately ignited and continuously maintained while flying away from an IR radiating target mounting said launching means and while floating on the water to draw an IR radiation seeking missile away from said target.

6. A decoy according to claim 5 in which said IR plume is started immediately at said safe separation distance and is maintained continuously until all said fuel is burned.

7. A decoy according to claim 6 further comprising:

means for stabilizing the flight of said decoy; and means connected to said stabilizing means for deploying said stabilizing means after a predetermined interval.

8. A decoy according to claim 7 in which each said stabilizing means includes at least one parachute to slow the descent of said decoy and hold one end of said decoy in an upright position to emit said IR plume upwardly.

9. A decoy according to claim 8 in which said launcher is tubular and mounted on a ship, and said stabilization means has a flotation collar to further slow the descent of said decoy and keep said one end in an upright position above the water.

10. A decoy according to claim 9 in which said deploying means includes a battery, timing circuit, and separation charge to deploy said parachute and said flotation collar.

11. A decoy according to claim 10 wherein said safe and arm section has bellows coupled to receive said launch pressure to displace said cocking bar having said valve hole for said fuel that is aligned to receive said fuel and valve said fuel to said spraying means.

12. A decoy according to claim 11 wherein said safe and arm section has said slider bar having said slider hole positioned to transmit said explosive train between said propelling means and an initiator coupled to said generating means.

13. A decoy according to claim 12 wherein said safe and arm section has a detent ball engaging said cocking bar as said fuel valve hole is aligned with said spraying means to assure said continuous IR plume.

14. A decoy according to claim 13 wherein said fuel storing means has a port on a flexible pickup tube inside a fuel tank to assure said continuous IR plume throughout the deployment sequence of said decoy.

15. A decoy according to claim 13 in which said fuel storing means has, weighted nose portion to help hold one end of said decoy in an upright position to emit said IR plume upwardly and keep said one end in an upright position above the water.

16. A decoy according to claim 1 wherein said launching means said decoy is selected from a group consisting of a rocket and a mortar.

* * * * *